US005808279A

United States Patent [19]

De Nichilo

[11] Patent Number: 5,808,279

[45] Date of Patent: Sep. 15, 1998

[54] HEATING PANEL FOR MAKING OVENS FOR THERMOFORMING APPARATUS

[75] Inventor: Giorgio De Nichilo, Melzo, Italy

[73] Assignee: R.I.G.O. Group S.R.L., Milan, Italy

[21] Appl. No.: 650,980

[22] Filed: May 21, 1996

[30] Foreign Application Priority Data

Mar. 27, 1996 [IT] Italy ..... MI96A0608

[51] Int. Cl.[6] ..... H05B 3/06; F27D 11/00; H01C 1/01; H01C 10/14

[52] U.S. Cl. ..... 219/537; 219/385; 338/315; 338/318

[58] Field of Search ..... 219/532, 536, 219/537, 538, 539, 400, 402, 385, 388; 338/315, 317, 318, 319

[56] References Cited

U.S. PATENT DOCUMENTS

| | | | |
|---|---|---|---|
| 2,240,913 | 5/1941 | Roskos | 219/537 |
| 2,254,925 | 9/1941 | Wirth | 219/537 |
| 2,430,490 | 11/1947 | Bray | 219/537 |
| 3,786,230 | 1/1974 | Brandenburg, Jr. | 219/537 |
| 4,322,605 | 3/1982 | Stimens | 219/532 |
| 4,400,612 | 8/1983 | Lee | 219/537 |
| 4,651,124 | 3/1987 | Kirilloff et al. | 338/537 |

*Primary Examiner*—Teresa J. Walberg
*Assistant Examiner*—Sam Paik
*Attorney, Agent, or Firm*—Bucknam and Archer

[57] ABSTRACT

An improved construction panel, in particular for ovens to be used in heating stations of thermoforming apparatus, comprises two separated portions, that is: a front portion (2) provided with heating elements; and a rear portion (3) holding the related power supply electric cables. The panel allows to reduce the thermal losses toward the rear of the construction thereof, so as to prevent the electric cables from being overheated and so as to prevent damages to the maintenance operators.

3 Claims, 7 Drawing Sheets

HEATING PANEL FOR MAKING OVENS FOR THERMOFORMING APPARATUS

BACKGROUND OF THE INVENTION

The present invention relates to a heating panel of improved construction, in particular for making ovens to be used in heating stations of thermoforming apparatus.

The ovens of the type to which the present invention relates essentially comprise panel elements, which have a surface suitable to heat a plate or continuous sheet of a plastic material to be processed by a thermoforming process.

Prior panels for the mentioned application have an essentially single-piece construction provided, at the heating surface thereof, with a plurality of heating electric resistances facing the plastic material and, on the opposite side thereof, power supply electric cables for power supplying the mentioned electric resistances, as well as with means for connecting the electric resistances to the panel.

However, the above conventional construction has the drawback that it is not suitable to efficiently prevent thermal losses on the panel portions on the rear of the electric resistance. Such a thermal loss not only constitutes a great power consume, but in addition negatively affects the electric cable materials, which, because of this reason, must be suitable to resist against high temperatures.

Thus, it can be stated that the thermal losses associated with conventional ovens for heating stations will involve very high operating costs, both of a direct type (due to the lost thermal power, that is power not absorbed by the material to be thermoformed) and of an indirect type (that is due to a high cost of the electric cables to be used).

Moreover, the above mentioned prior panels are also affected by the drawback that their maintenance is very difficult. In fact, the single piece construction of the mentioned panels includes, inside an individual assembly, both the heating electric resistances and the electric power supply cables, thereby the electric resistances can be hardly detached from the related support panel. Moreover, the application of connecting means for connecting the electric resistances on the rear portion or wiring portion of the panels compells to use two operators: one for supporting the electric resistances on the front portion and the other for detaching, on the rear portion of the panel, the wiring assembly and for removing the connecting means connecting the heating elements.

SUMMARY OF THE INVENTION

Accordingly, the aim of the present invention is to provide an improved construction heating panel specifically designed for efficiently reducing the thermal losses toward the electric cables system power supplying the electric resistances of the oven.

Within the scope of the above mentioned aim, a main object of the present invention is to provide such an oven construction which allows the heating elements to be simply and quickly handled, thereby allowing a single maintenance operator to handle the heating electric resistances.

According to one aspect of the present invention, the above mentioned aim and object, as well as yet other objects, are achieved by an improved construction heating panel, in particular for making ovens for thermoforming apparatus heating stations, of the type provided with a surface including a plurality of heating elements facing a plastic material to be plasticized, essentially characterized in that said panel has a structure constituted by two separated portions and, more specifically:

a front portion, that is facing the plastic material to be heated, and including said heating elements; and a rear portion, that is facing that side opposite to said front portion holding the electric power supply cables for power supplying said heating elements.

Further characteristics of the panel according to the present invention are stated in the dependent claims 2 to 10.

With respect to conventional systems, the oven according to the present invention has the advantage of greatly reducing the thermal losses toward the rear part of the construction thereof. This, in addition to overcoming power loss problems, will prevent undesired over-heatings of the electric cables and will reduce burning dangers in the maintenance of the system. In particular, owing to the claimed construction, the temperature in the region of the electric cables can be reduced from 160° C. to about 90° C.

In turn, the power not lost on the rear can be used on the front of the panel, i.e. on the side of the plastic material to be processed. Thus, the invention will allow to use electric resistances having a rated power of 30% less, thereby providing an electric power saving of about 20%, while providing the same end result with respect to the quality of the thermoformed product and with respect to the production yield.

The oven construction according to the present invention provides moreover the advantage that a single operator can perform the two operations of disengaging of the electric cables on the rear of the panels and disengaging the electric resistances from the front part of said panel.

BRIEF DESCRIPTION OF THE DRAWINGS

These and other features and advantages of the heating panel according to the present invention will become more apparent from the following disclosure with reference to the figures of the accompanying drawings.

These figures, which relate to a preferred embodiment of the subject panel shown exclusively by way of example, show.

DESCRIPTION OF THE PREFERRED EMBODIMENT

Figure 1:
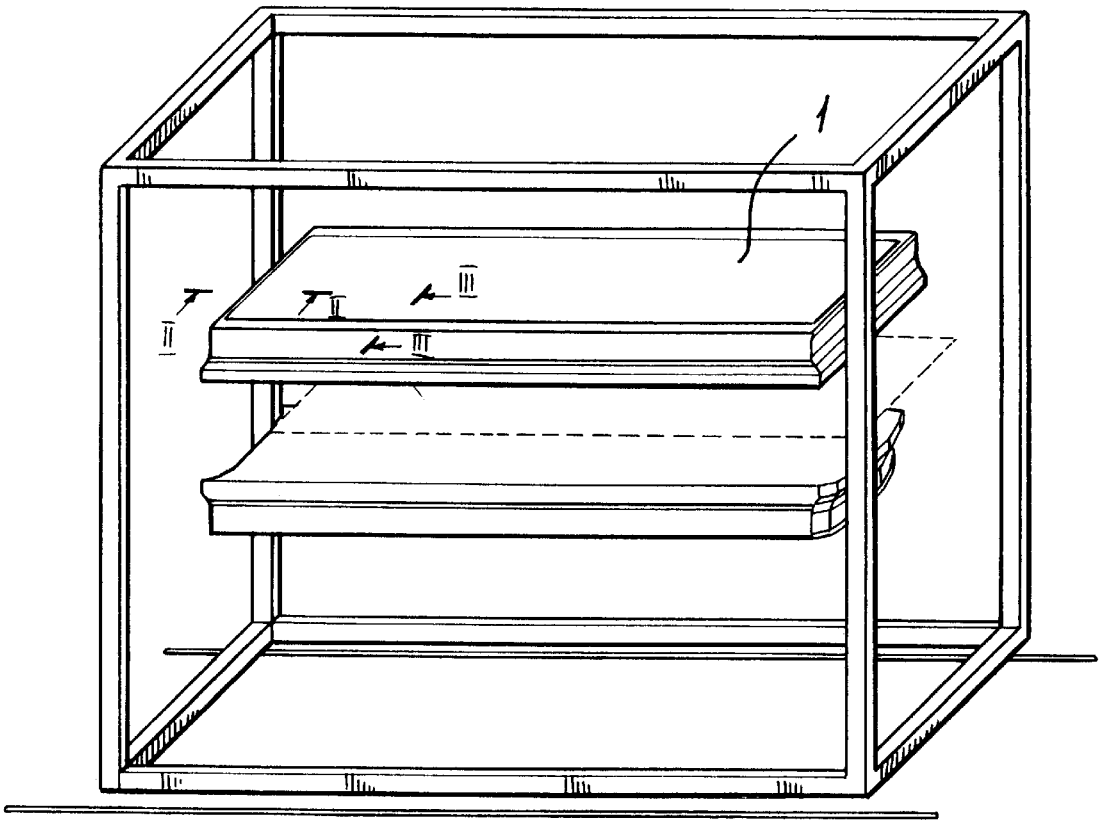
FIG. 1 the oven system including the improved construction according to the present invention.

The panel according to the present invention has been generally indicated by the reference number 1 in FIG. 1, in its assembled condition at a heating station of a plastic material thermoforming apparatus. The panel, which constitutes one of the ovens of the mentioned station, has an improved construction, essentially comprising two portions:

a front portion 2, i.e. facing the plastic material to be heated, constituted by a metal box-like element for supporting the electric resistances 6; and a rear portion 3, i.e. facing the side opposite to the side 2, holding the electric cables 4 connected to the clamps 5 of the electric resistances 6, as well as the electric cables (not shown) connecting the clamps 5 to the main electric control panel.

As is clearly shown in FIGS. 2 to 5, the surface of the front portion 2 of the panel 1 which supports the heating elements or resistances 6 is constituted by a fretted sheet metal element, on the rised portions (12) thereof are affixed said electric resistances 6. Thus, the heating elements constituted by said electric resistances will be held well separated away from the bottom of that construction portion 2 which is arranged near the position of the cables 4.

Figure 2:
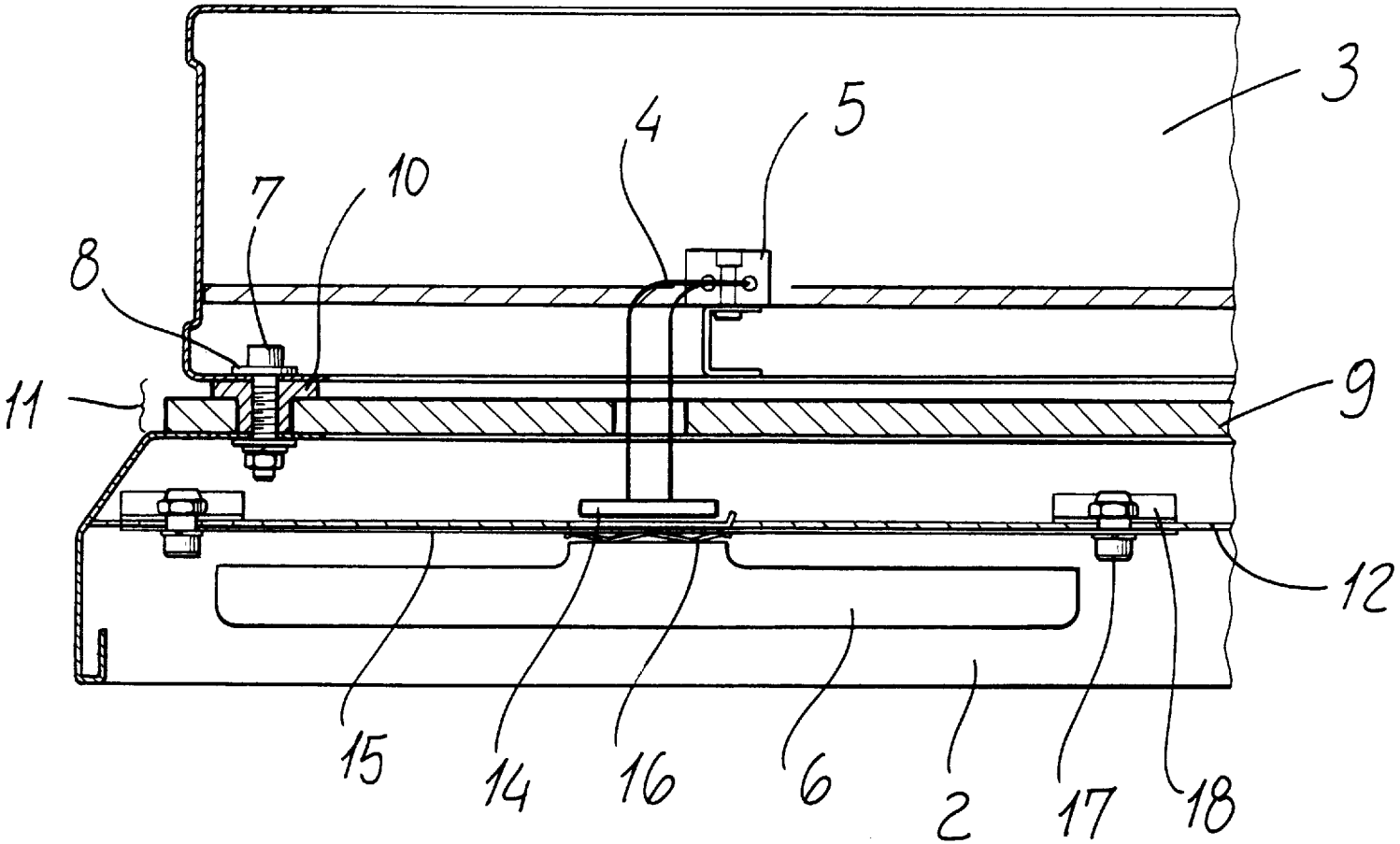
FIGS. 2 and 3 the detail A of FIG. 1, in cross section respectively taken along the section lines II—II and III—III.
Figure 3:
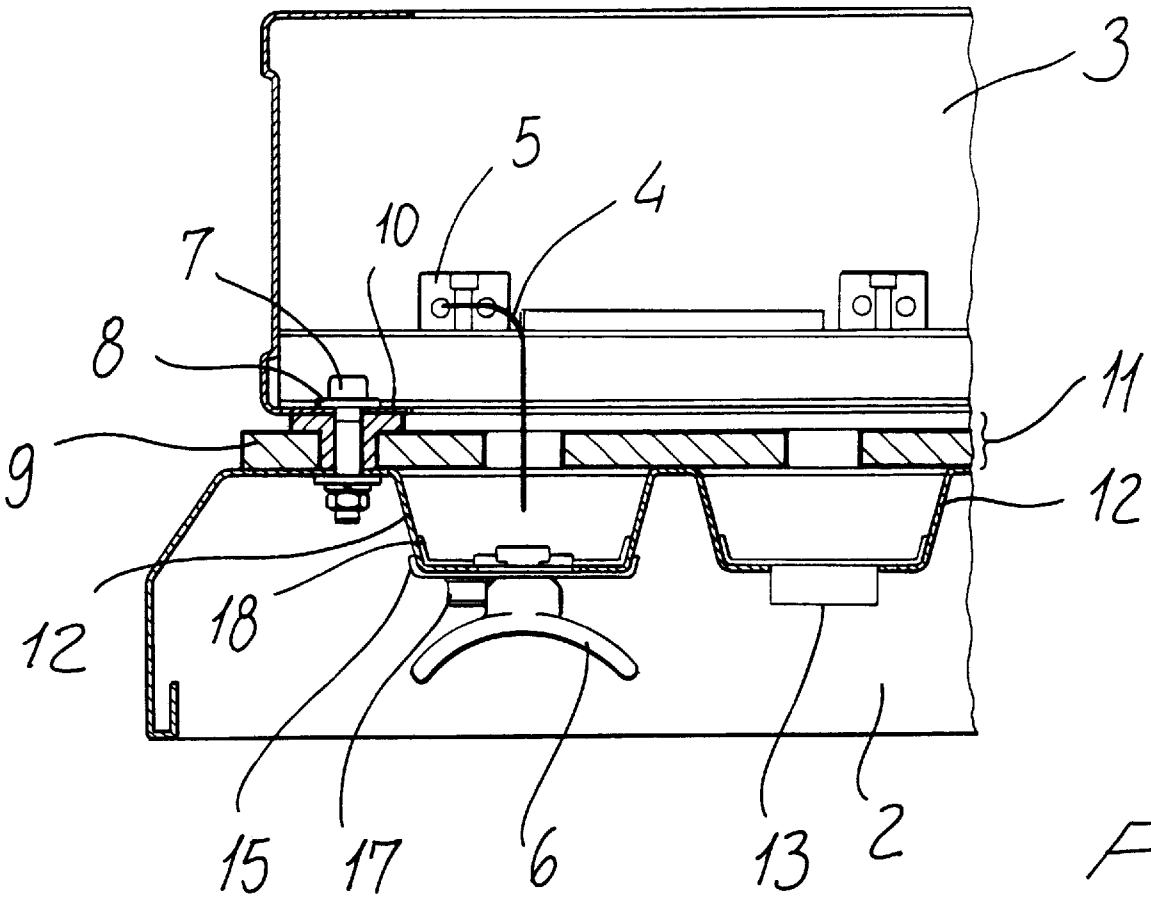

Between the front portion 2 and rear portion 3 of the panel 1 is arranged a thermally insulating material 9, which is housed in the gap 11 separating the two mentioned construction portions (FIGS. 2 and 3). The mutual connection of the front and rear portions of the oven, with the thermally insulating layer 9 arranged therebetween, is performed by using screws 7, upon having applied a spacer sleeve element 10 (which is advantageously coaxially arranged on the stem of the respective screw 7, to provide the mentioned gap 11. Inserts 8 made of a thermoinsulating material are moreover provided on the contact sections of the screws 7 and construction portions 2 and 3, in order to reduce any thermal bridging.

Figure 4:
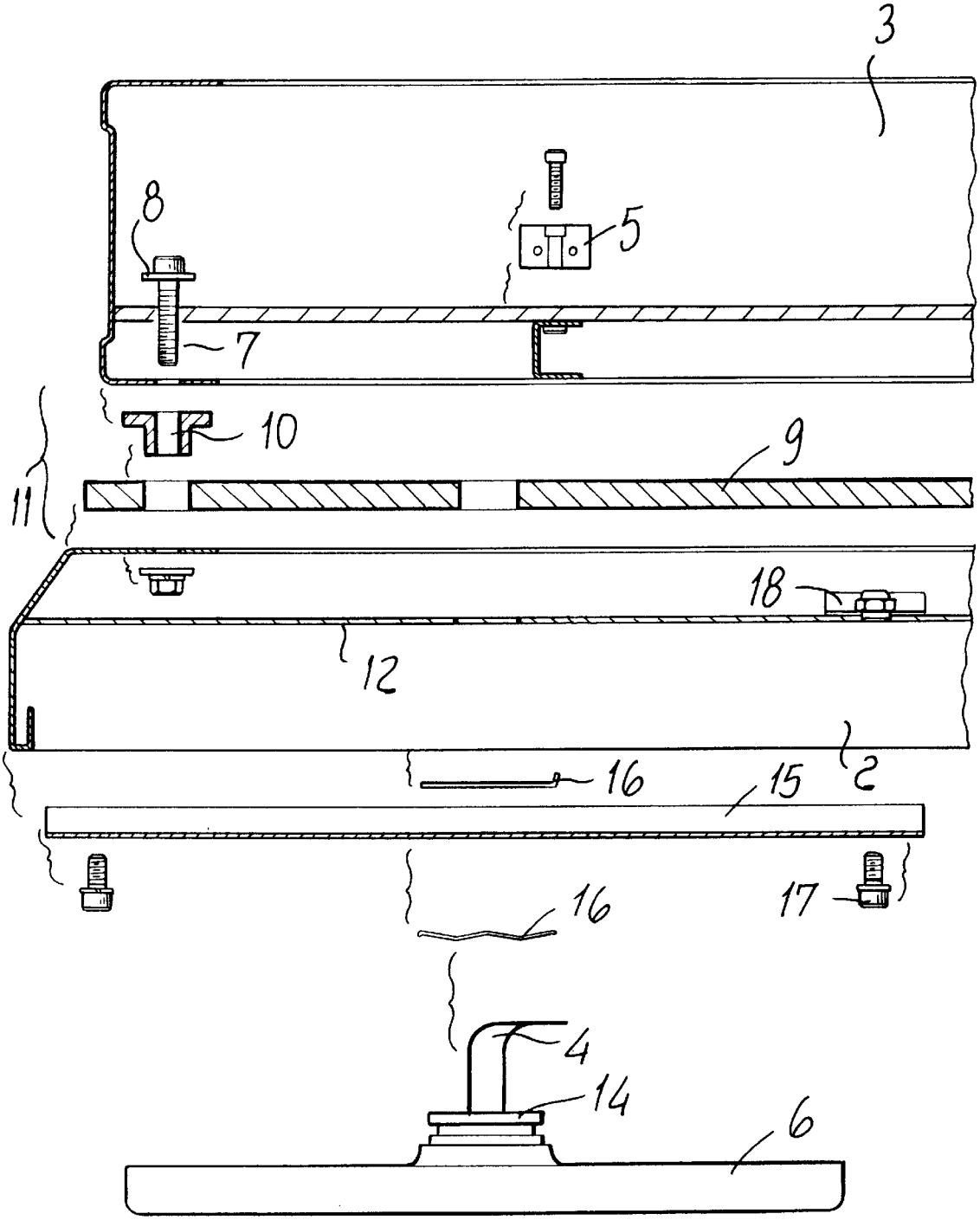
FIGS. 4 and 5 exploded cross-sectional views of FIGS. 2 and 3 respectively.
Figure 5:
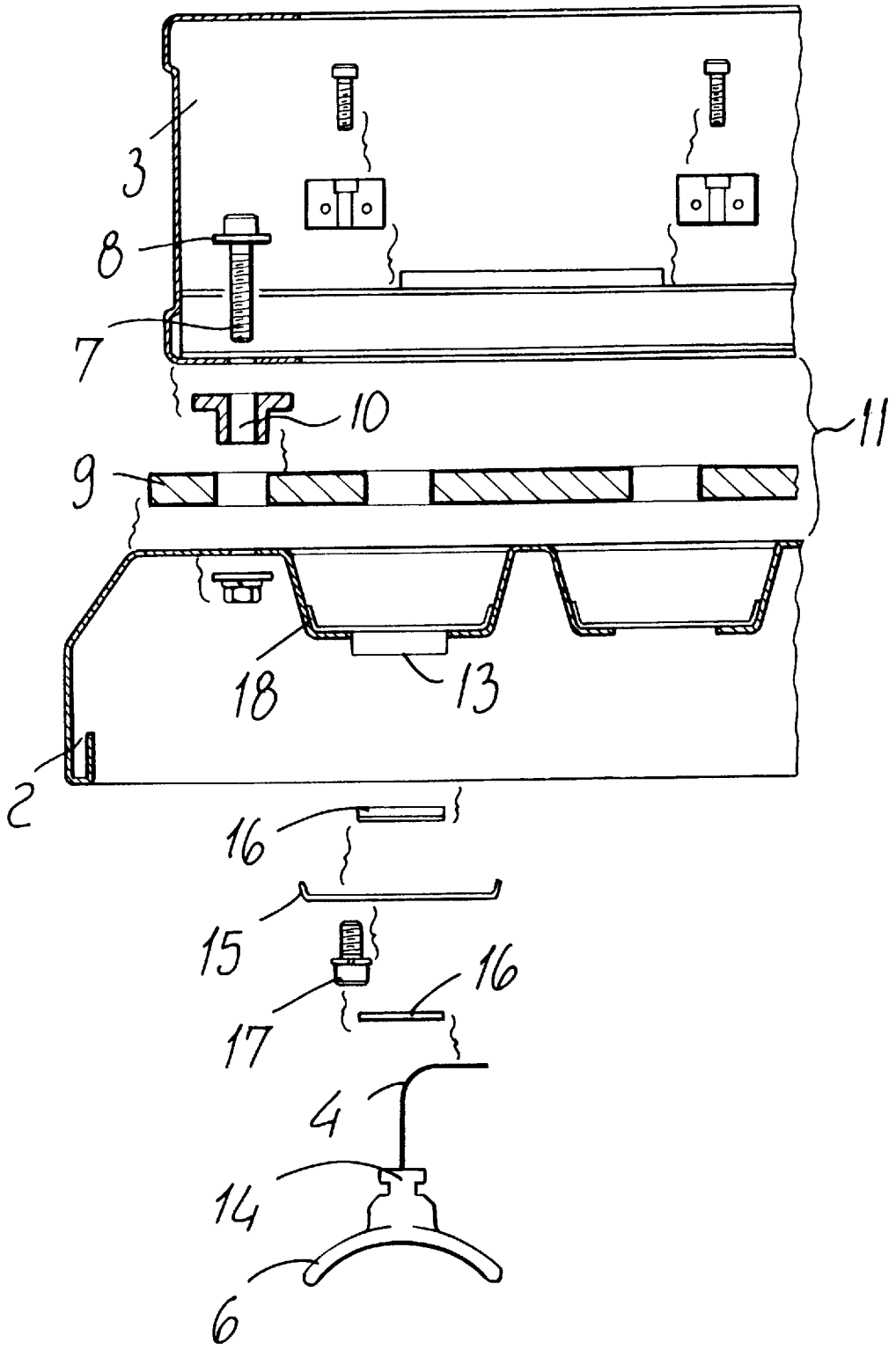
Figure 6:
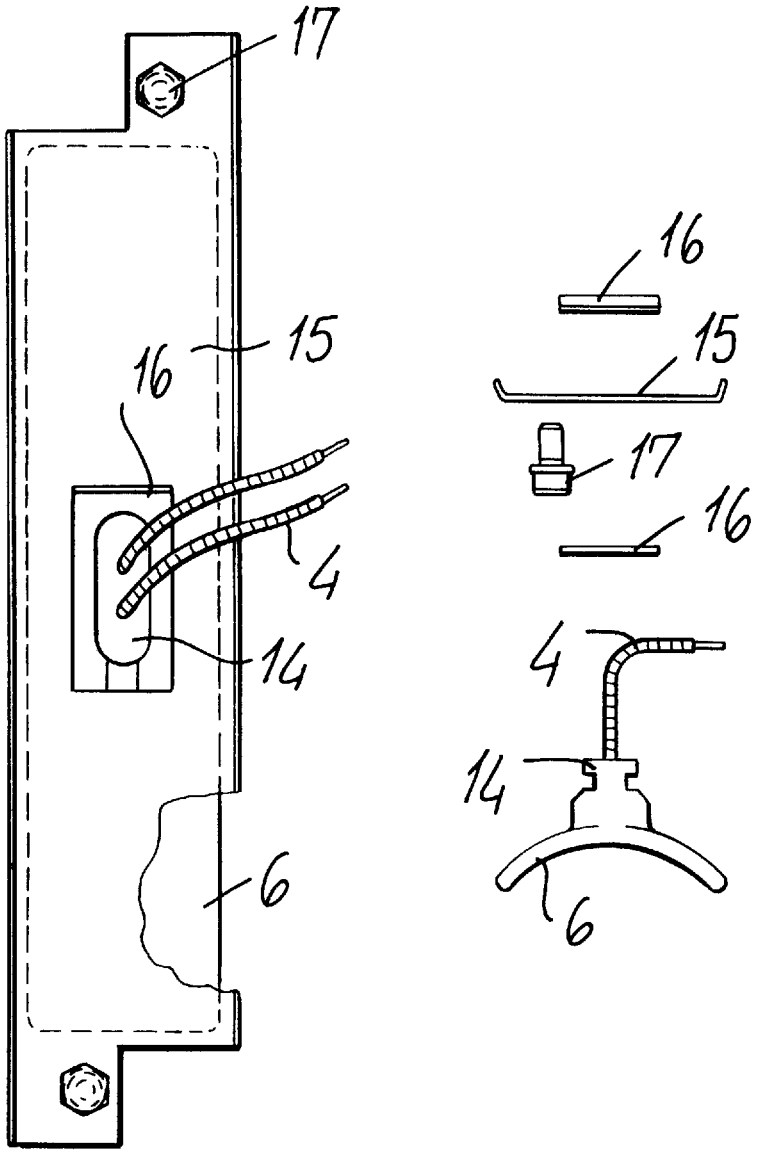
FIG. 6 a detail of the system for assembling a single electric resistance on the supporting tile element thereof, and FIG. 7 the detail of the assembly of FIG. 4, supported on the panel.
Figure 7:
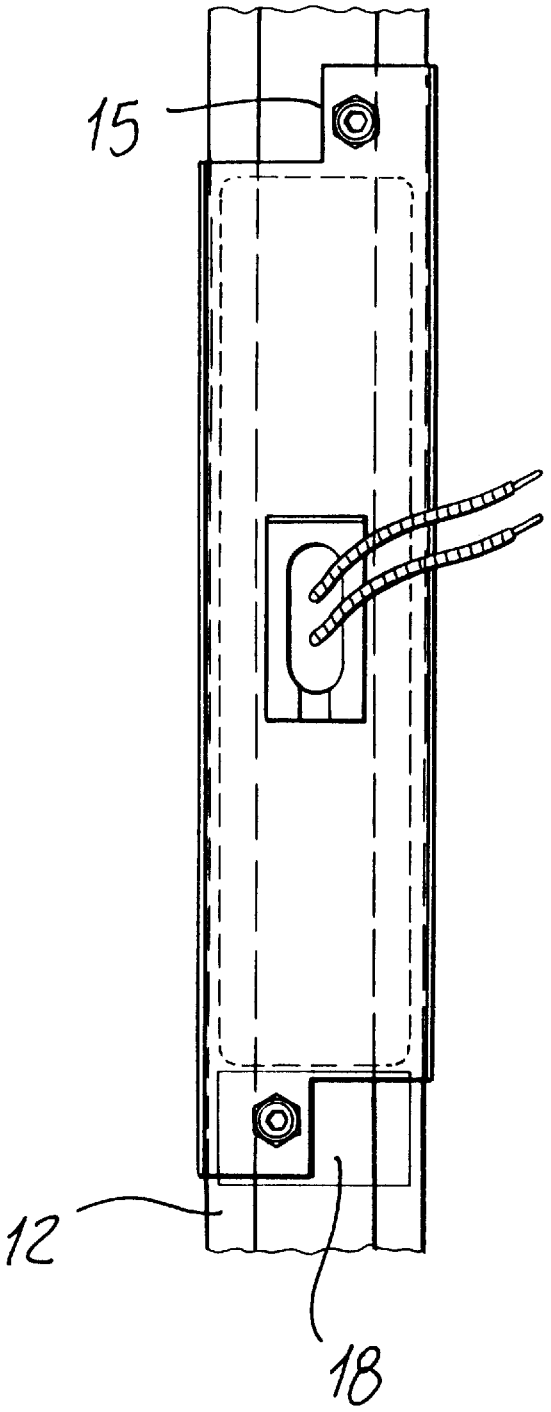

The connection of the electric resistances 6 to the front portion 2 of the oven is clearly shown in FIG. 4. The raised portion 12 of the fretted construction 2 is provided with an opening 13 in which is engaged the rear portion or "base" 14 of the electric resistances 6. Before the mentioned engagement, said base 14 will be provided with a supporting tile element 15 constituting the supporting element for supporting said electric resistance on the mentioned fretted portion 12.

The, the base portion 4 of the electric resistances 6 projecting under the supporting element 15 will be locked in its position by means of a small spring 16. The end connection of the electric resistance 6, supporting element 15, spring 16 system to the fretted portion 12 will be then performed by screws 17 engaging on the supporting element 15 and on guide elements 18 arranged on the bottom side of the fretted portions or elements 12.

While the invention has been disclosed and illustrated with reference to a preferred embodiment thereof, it should be apparent that the disclosed embodiment is susceptible to several modifications and variations all of which will come within the scope of the invention. Thus, for example, the configuration of the front and rear portions of the oven can be different from the disclosed configuration. The connecting means for connecting the electric resistances to the front portion 2 of the oven can be of any desired suitable types, provided that they are equivalent to the disclosed connecting element.

I claim:

1. An improved construction heating panel, in particular for making ovens to be used in thermoforming apparatus heating stations, of a type provided with a surface including a plurality of heating elements facing a plastic material to be heated, said panel comprising two separated portions, said two portions comprising a front portion facing said plastic material to be heated, including said heating elements; and a rear portion facing a side opposite to that of said front portion, holding electric power supply cable means for power supplying said heating elements, said panel further comprising a gap on a portion thereof connecting said front and rear portions thereof, said gap holding therein a thermally insulating material, said rear portion comprising a box-like element inside of which are provided clamp means for connecting said heating elements to said electric power supply means, said panel further comprises screws for connecting said front and rear portions, said screws having engagement surfaces, a spacer sleeve being provided on said screws for holding said separated front and rear portions, said panel comprising moreover thermally insulating material inserts (9) arranged between said engagement surfaces of said screws and said front and rear portions of said panel, wherein said front portion is provided with a fretted surface having raised portions on which are connected said heating elements.

2. The panel according to claim 1, wherein said heating elements comprise electric resistances having an attachment base.

3. The panel according to claim 2, wherein each said raised portion of said front portion is provided with an opening for receiving therein said base of said electric resistances, a supporting tile element being moreover provided for supporting said electric resistances on said fretted portion.

* * * * *